US008506259B2

(12) United States Patent
Kurz et al.

(10) Patent No.: US 8,506,259 B2
(45) Date of Patent: Aug. 13, 2013

(54) FLUID COMPRESSION SYSTEM

(75) Inventors: Rainer Kurz, San Diego, CA (US); Robert C. White, San Diego, CA (US)

(73) Assignee: Solar Turbines Inc., San Diego, CA (US)

( * ) Notice: Subject to any disclaimer, the term of this patent is extended or adjusted under 35 U.S.C. 154(b) by 177 days.

(21) Appl. No.: 12/977,137

(22) Filed: Dec. 23, 2010

(65) Prior Publication Data

US 2012/0006411 A1 Jan. 12, 2012

Related U.S. Application Data

(60) Provisional application No. 61/289,442, filed on Dec. 23, 2009.

(51) Int. Cl.
*F04B 41/06* (2006.01)

(52) U.S. Cl.
USPC ..... 417/3; 417/7; 137/565.29

(58) Field of Classification Search
USPC ..... 417/3, 7; 137/565.29
See application file for complete search history.

(56) References Cited

U.S. PATENT DOCUMENTS

| | | | | |
|---|---|---|---|---|
| 571,328 | A | 11/1896 | Barrett | |
| 1,904,320 | A | 4/1933 | Marples | |
| 2,532,856 | A | 12/1950 | Ray | |
| 2,551,241 | A | 5/1951 | Buckland | |
| 3,269,401 | A | 8/1966 | Scott et al. | |
| 3,292,647 | A | 12/1966 | Scott | |
| 3,508,415 | A | 4/1970 | Ospina-Racines | |
| 3,746,027 | A | 7/1973 | Elliott | |
| 3,983,895 | A | 10/1976 | Pouska et al. | |
| 4,204,808 | A | 5/1980 | Reese et al. | |
| 4,793,777 | A | 12/1988 | Hauenstein | |
| 4,887,941 | A | 12/1989 | Crinquette et al. | |
| 5,622,478 | A * | 4/1997 | Elliott et al. | 417/53 |
| 6,120,260 | A | 9/2000 | Jirele | |
| 2005/0252223 | A1 | 11/2005 | Jung et al. | |

FOREIGN PATENT DOCUMENTS

FR 2833040 6/2003

* cited by examiner

*Primary Examiner* — Charles Freay
*Assistant Examiner* — Patrick Hamo
(74) *Attorney, Agent, or Firm* — Mark Hull; Procopio, Cory, Hargreaves & Savitch LLP

(57) ABSTRACT

A fluid compression system is disclosed. The fluid compression system may include a first compressor disposed in a first fluid conduit, a first valve disposed in the first fluid conduit upstream of the first compressor, a second valve disposed in the first fluid conduit downstream of the first compressor, a second compressor in fluid communication with the first compressor and configured to selectively pump fluid from the first compressor.

16 Claims, 1 Drawing Sheet

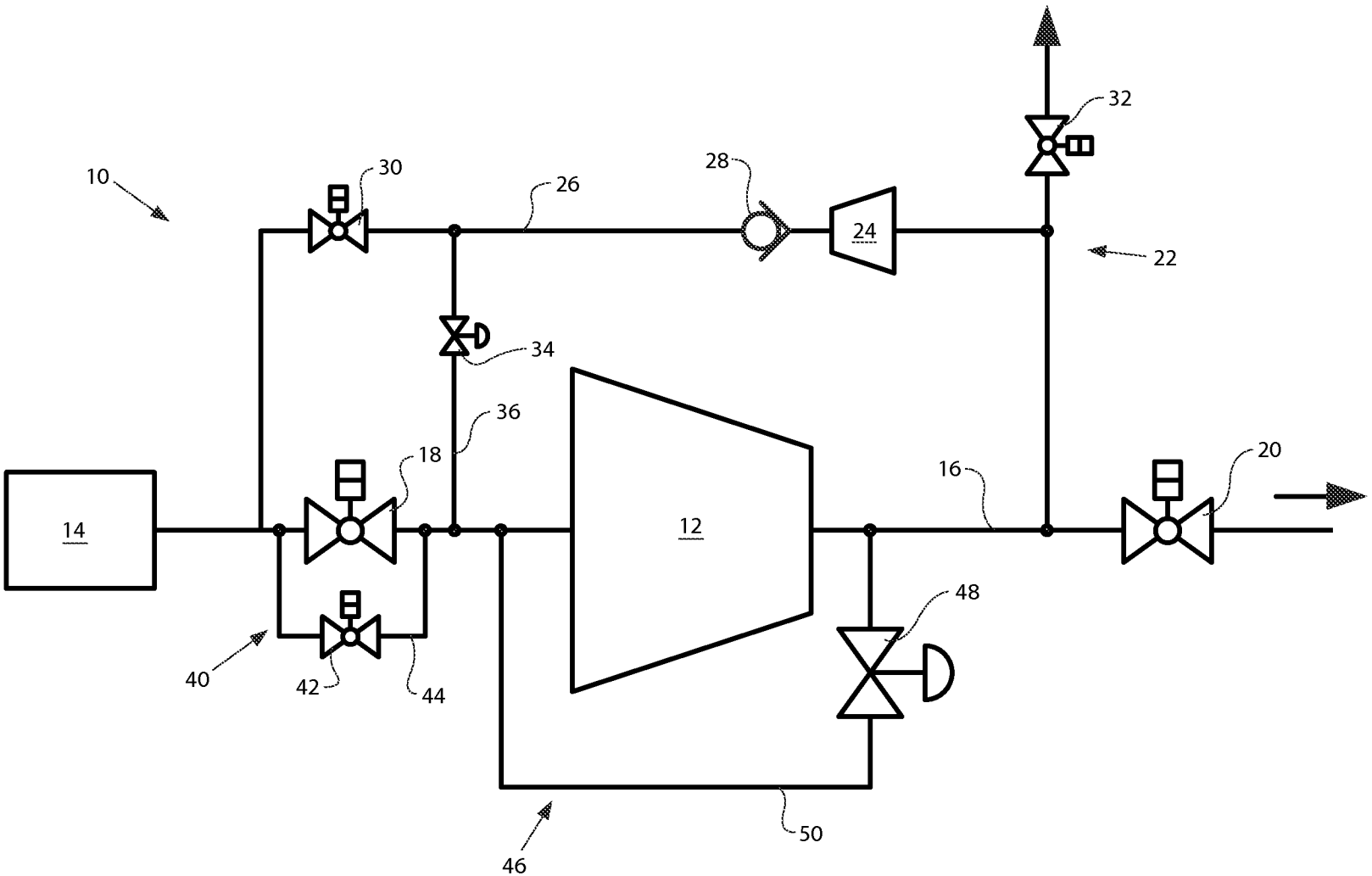
10
12
14
16
18
20
22
24
26
28
30
32
34
36
40
42
44
46
48
50

FLUID COMPRESSION SYSTEM

RELATED APPLICATIONS

This application is based upon and claims the benefit of priority from U.S. Provisional Application No. 61/289,442 by Ranier Kurz et al., filed Dec. 23, 2009, the contents of which are expressly incorporated herein by reference.

TECHNICAL FIELD

The present disclosure is directed to a fluid compression system. In particular, the present disclosure is directed to a fluid compression system having a compressor depressurization arrangement for reducing fluid pressure in the compressor and adjacent fluid conduit(s).

BACKGROUND

Gas pipelines are used to transport natural gas over long distances. Compressor stations are positioned at intervals along the pipeline to pump the natural gas through the pipe. The gas flows by expanding in the pipe from the discharge of one compressor to the suction side of the next compressor.

The compressors used in the stations are configured to run continuously, but may need to be shutdown periodically. Typically, when shutdown, the compressor is isolated by closing valves upstream and downstream of the compressor. In some instances, the gas in the compressor and in the pipe between the valves is vented to atmosphere. In other situations, the compressor may be placed in a pressurized hold in which the gas pressure is maintained in the compressor and in the pipe between the valves. Due to the high pressure of the gas, however, some gas may leak to atmosphere past the dry seals in the compressor. Both venting gas to atmosphere and allowing high pressure gas to leak from the compressor seals to atmosphere is wasteful and environmentally unfriendly.

The fluid compression system of the present disclosure addresses one or more of issues set forth above.

SUMMARY OF THE DISCLOSURE

In one aspect, the present disclosure is directed toward a fluid compression system. The fluid compression system may include a first compressor disposed in a first fluid conduit, a first valve disposed in the first fluid conduit upstream of the first compressor, a second valve disposed in the first fluid conduit downstream of the first compressor, a second compressor in fluid communication with the first compressor and configured to selectively pump fluid from the first compressor.

According to another aspect, the present disclosure is also directed toward a method of operating a fluid compression system. The method may include compressing a fluid at a first location, ceasing compressing fluid at the first location, and compressing fluid at a second location, wherein compressing fluid at a second location reduces fluid pressure at the first location.

BRIEF DESCRIPTION OF THE DRAWINGS

In the accompanying drawings, which are incorporated in and constitute a part of this specification, exemplary embodiments of the disclosure are illustrated, which, together with the written description, serve to explain the principles of the disclosed system:

FIG. 1 is a schematic of an exemplary disclosed compressor system.

DETAILED DESCRIPTION

Referring to FIG. 1, an exemplary fluid compression system 10 is disclosed. The fluid compression system 10 may be configured to pressurize a variety of fluids. In one embodiment, the fluid compression system 10 is configured to pressurize gas, such as natural gas, for example. The fluid compression system 10 includes a first compressor 12 in fluid communication with a fluid source 14 via a first fluid conduit 16. The fluid source 14 may be, for example, a natural gas wellhead, a compressor station upstream of the disclosed fluid compression system, or any other suitable source of fluid. The first fluid conduit 16 may be a pipe configured to transport pressurized gas.

The first compressor 12 may be configured in a variety of ways. Any compressor capable of pressurizing fluid to may be used. In one embodiment, the first compressor 12 is a centrifugal compressor. The first compressor may be driven by an electric motor, internal combustion engine (such as a turbine engine, for example), or another suitable power source.

The fluid compression system 10 may also include a first valve 18 disposed in the first fluid conduit upstream of the first compressor 12 and a second valve 20 disposed in the first fluid conduit 16 downstream of the first compressor 12. The first valve 18 and the second valve 20 may be any suitable valve capable of preventing the flow of fluid through the first fluid conduit 16 when closed and allowing the flow of fluid through the first fluid conduit 16 when open. The first valve 18 and the second valve 20 may be actuated by any suitable means, such as for example, pneumatically, electrically, or manually.

The fluid compression system 10 may also include a depressurization arrangement 22. The depressurization arrangement 22 is configured to reduce the fluid pressure in the first compressor 12 and in the first fluid conduit 16 between the first valve 18 and the second valve 20 when the first compressor is not operating. In the depicted embodiment, the depressurization arrangement 22 includes a second compressor 24 or pumping device disposed in a second fluid conduit 26. The second compressor 24 may be any suitable compressor, such as a centrifugal compressor or a reciprocating compressor. The second compressor 24 may be driven by any suitable means such an electric motor or internal combustion engine.

The second fluid conduit 26 fluidly couples the first fluid conduit 16 between the first valve 18 and the second valve 20 with the first fluid conduit 16 upstream of the first valve 18 (shown in FIG. 1) or with the first fluid conduit 16 downstream of the second valve 20. A check valve 28 and a third valve 30 may also be disposed in the second fluid conduit 26. In FIG. 1, the check valve 28 is illustrated as being between the third valve 30 and the second compressor 24. In other embodiments, however, the check valve 28 may be located in a fluid conduit between the first compressor 12 and the second compressor 24. The third valve 30 may be any suitable valve capable of preventing the flow of fluid through the second fluid conduit 26 when closed and allowing the flow of fluid through the second fluid conduit 26 when open. The third valve 30 may be actuated by any suitable means, such as for example, pneumatically, electrically, or manually.

The depressurization arrangement 22 may also include a vent valve 32 configured to fluidly couple the first fluid conduit 16 between the first valve 18 and the second valve 20 with atmosphere. In the depicted embodiment, the vent valve 32 is fluidly coupled to the second fluid conduit 22. The vent valve 32 may be actuated by any suitable means, such as for example, pneumatically, electrically, or manually.

The fluid compression system 10 may also include a pressure regulator 34 disposed in a third fluid conduit 36. The third fluid conduit 36 fluidly couples the first fluid conduit 16 between the first valve 18 and the second valve 20 with the first fluid conduit 16 upstream of the first valve 18. The pressure regulator 34 may be any suitable regulator capable of regulating the pressure at the first compressor 12. In the depicted embodiment, the pressure regulator 34 is configured to maintain a positive pressure in the first compressor 12 when the first compressor is shutdown.

The fluid compression system 10 may also include a loading arrangement 40. The loading arrangement 40 may include a fourth valve 42 disposed in a fourth fluid conduit 44 that fluidly couples the first fluid conduit 16 upstream of the first valve 18 with the first fluid conduit 16 downstream of the first valve 18. The fourth valve 42 being movable between a closed position that prevent flow through the fourth fluid conduit 44 and an open position that allow flow through the fourth fluid conduit 44. The fourth valve 42 may be actuated by any suitable means, such as for example, pneumatically, electrically, or manually.

The fluid compression system 10 may also include an anti-surge arrangement 46 that includes a fifth valve 48 disposed in a fifth fluid conduit 50. The fifth valve 48 being movable between a closed position that prevent flow through the fifth fluid conduit 50 and an open position that allow flow through the fifth fluid conduit 50. The fifth valve 48 may be actuated by any suitable means, such as for example, pneumatically, electrically, or manually.

The fluid compression system 10 may also include a pressure sensor (not shown) configured to provide a signal indicative of the fluid pressure in the first compressor 12 and/or adjacent fluid conduit(s), such as the first fluid conduit 16 between the first valve 18 and the second valve 20. The fluid compression system 10 may have a controller (not shown) configured to receive the signal from the pressure sensor and actuate one or more valves and/or turn on or off the first compressor 12 and/or the second compressor 24.

INDUSTRIAL APPLICABILITY

The disclosed fluid compression system 10 may be used in a gas pipeline, such as natural gas, to transport the natural gas through the pipeline. The disclosed fluid compression system 10 may be utilized to reduce the start energy required for starting the first compressor by depressurizing the fluid from the first compressor 12 and adjacent fluid conduit(s). In addition, the disclosed fluid compression system 10 provides the ability of keeping the first compressor 12 in a pressurized hold without needing to maintain the gas pressure in the first compressor 12 at a high level. During the pressurized hold, the fluid in the first compressor 12 may be kept slightly above atmospheric pressure, thus no air will leak into the first compressor 12 and the need to purge air from the system will be avoided. At the same time, the reduced pressure will result in reduced fluid losses across the dry air seals to the atmosphere, resulting in efficiency and environmental benefits.

The operation of the fluid compression system 10 will now be described. When operating in a compressing mode, the first compressor 12 is operating, the second compressor is not operating, the first valve 18 is open, the second valve 20 is open, the depressurization arrangement 22 is closed (i.e. the third valve 30 is closed), the loading arrangement 40 is closed (i.e. the fourth valve 42 is closed), and the anti-surge arrangement 46 is closed (i.e. the fifth valve 48 is closed). In the compressing mode, the first compressor 12 compresses fluid from the fluid source 14 and the compressed fluid flows under pressure through the first fluid conduit 16 downstream of the first compressor 12.

The fluid compression system 10 may also be placed in a pressurized hold mode. In the pressurized hold mode, the first compressor 12 is not operating, the first valve 18 is closed, the second valve 20 is closed, the depressurization arrangement 22 is open (i.e. the third valve 30 is open), the loading arrangement 40 is closed (i.e. the fourth valve 42 is closed), and the anti-surge arrangement 46 is closed (i.e. the fifth valve 48 is closed). Closing the first valve 18 and the second valve 20 isolates the first compressor 12 from the fluid source 14 upstream of the first valve 18 and from pressurized fluid in the first fluid conduit 16 downstream from the second valve 20. Initially during a pressurized hold, the second compressor 24 is operating. As a result, the second compressor 24 begins pumping pressurized fluid from the first compressor 12 and the first fluid conduit 16 between the first valve 18 and the second valve 20. The second compressor 24 discharges the fluid through the second fluid conduit 26 back to the first fluid conduit 16 upstream of the first valve 18. Thus, the fluid is returned to the first fluid conduit 16 as opposed to being vented to atmosphere.

Once the fluid pressure in the first compressor 12 and the first fluid conduit 16 between the first valve 18 and the second valve 20 is below a predetermined amount of pressure, the second compressor 24 is stopped. The predetermined amount of pressure may be a value that is slightly above atmospheric pressure, such as 1-3 psig, though other amounts of pressure may also be selected as desired. In one embodiment, a control system receives a signal from a pressure sensor indicative to the pressure in the first compressor 12 and the first fluid conduit 16 between the first valve 18 and the second valve 20 and sends a signal to stop the second compressor 24 if the pressure reaches a predetermined amount of pressure.

While the second compressor 24 is not operating during a pressurized hold, the third valve 30 remains open. Thus, pressurized fluid from the fluid source 14 remains in fluid communication with the second fluid conduit 26 and the third fluid conduit 36. The check valve 28 is configured and positioned to block the pressurized fluid from flowing back through the second fluid conduit 26 to the first compressor 12.

The pressure regulator 34, however, allows some pressurized fluid to flow through the third fluid conduit 36 to the first compressor 12. The pressure regulator 34 may be configured to maintain a positive pressure that is slightly above atmospheric pressure in the first compressor 12. For example, the pressure regulator 34 may be configured or adjusted to maintain about 1-6 psig pressure in the first compressor 12. In this way, during a pressurized hold, the positive pressure can be maintained in the first compressor 12 to ensure that air is not drawn into the first compressor 12 and the first fluid conduit 16 through the dry seals of the first compressor 12. Thus, the need to purge air from the system before resuming the compressing mode is eliminated. In addition, since the positive pressure is held to slightly above atmospheric pressure, as opposed to being held at full pressure if the fluid upstream of the first valve 18 (i.e. the fluid source pressure), the amount of fluid that leaks through the seals of the first compressor 12 to atmosphere during the pressurized hold mode is minimized.

Furthermore, the reduced pressure at the first compressor 12 may reduce the start energy required for starting the first compressor 12. For example, if the first compressor 12 is driven by an electric motor, the start-up power required to drive the compressor with the motor is less when the system is depressurized down to near atmospheric pressure.

It will be apparent to those skilled in the art that various modifications and variations can be made to the disclosed dosing system. Other embodiments will be apparent to those skilled in the art from consideration of the specification and practice of the disclosed method and apparatus. It is intended that the specification and examples be considered as exemplary only, with a true scope being indicated by the following claims and their equivalents.

What is claimed is:

1. A fluid compression system, comprising:

a first compressor disposed in a first fluid conduit;

a first valve disposed in the first fluid conduit upstream of the first compressor;

a second valve disposed in the first fluid conduit downstream of the first compressor;

a second compressor in fluid communication with the first compressor and configured to selectively pump fluid from the first compressor, the second compressor disposed in a second fluid conduit, the second fluid conduit fluidly couples the first fluid conduit between the first valve and the second valve with the first fluid conduit downstream of the second valve;

a pressure regulator configured to maintain a positive pressure of about 1-6 prig in the first compressor when the first compressor is not operating.

2. The fluid compression system of claim 1, wherein the second fluid conduit fluidly couples the first fluid conduit between the first valve and the second valve with the first fluid conduit upstream of the first valve.

3. The fluid compression system of claim 2, further comprising third valve disposed in the second fluid conduit and a check valve disposed in the second fluid conduit between the third valve and the second compressor.

4. The fluid compression system of claim 1, wherein the pressure regulator is disposed in a third fluid conduit.

5. The fluid compression system of claim 1, wherein third fluid conduit fluidly couples the first fluid conduit between the first valve and the second valve with the first fluid conduit upstream of the first valve.

6. The fluid compression system of claim 1, wherein the fluid is natural gas.

7. A method of operating a fluid compression system, comprising:

compressing a fluid at a first location;

ceasing compressing the fluid at the first location; and compressing the fluid at a second location, wherein compressing the fluid at the second location reduces fluid pressure at the first location, and wherein compressing the fluid at the second location comprises transferring the fluid from the first location to a third location that is upstream of the first location.

8. The method of claim 7 further comprising:

ceasing compressing the fluid at the second location; and maintaining a positive pressure at the first location.

9. The method of claim 8 wherein maintaining the positive pressure at the first location comprises transferring the fluid from the third location to the first location.

10. The method of claim 8, wherein the positive pressure is about 1 psig to about 6 psig.

11. The method of claim 7, further comprising:

measuring fluid pressure at the first location; and ceasing compressing fluid at the second location when the fluid pressure at the first location reaches a predetermined amount of pressure.

12. The method of claim 7, wherein the fluid is natural gas.

13. A method of operating a fluid compression system, comprising:

compressing a fluid at a first location;

ceasing compressing the fluid at the first location;

compressing the fluid at a second location, wherein compressing the fluid at the second location reduces fluid pressure at the first location;

ceasing compressing the fluid at the second location; and maintaining a positive pressure at the first location, comprising transferring the fluid from a third location to the first location.

14. The method of claim 13, wherein the positive pressure is about 1 psig to about 6 psig.

15. The method of claim 13, further comprising measuring fluid pressure at the first location; and wherein ceasing compressing the fluid at the second location is when the fluid pressure at the first location reaches a predetermined amount of pressure.

16. The method of claim 13, wherein the fluid is natural gas.

* * * * *